US008695693B2

(12) United States Patent
Nguyen et al.

(10) Patent No.: US 8,695,693 B2
(45) Date of Patent: Apr. 15, 2014

(54) WELLHEAD COMPONENT COUPLING SYSTEM AND METHOD

(75) Inventors: Dennis P. Nguyen, Pearland, TX (US); Kirk P. Guidry, Cypress, TX (US)

(73) Assignee: Cameron International Corporation, Houston, TX (US)

( * ) Notice: Subject to any disclaimer, the term of this patent is extended or adjusted under 35 U.S.C. 154(b) by 284 days.

(21) Appl. No.: 12/595,202

(22) PCT Filed: Mar. 11, 2008

(86) PCT No.: PCT/US2008/056541

§ 371 (c)(1), (2), (4) Date: Oct. 8, 2009

(87) PCT Pub. No.: WO2008/140856

PCT Pub. Date: Nov. 20, 2008

(65) Prior Publication Data

US 2011/0162852 A1 Jul. 7, 2011

Related U.S. Application Data

(60) Provisional application No. 60/928,241, filed on May 8, 2007.

(51) Int. Cl.
*E21B 19/00* (2006.01)

(52) U.S. Cl.
USPC ..... 166/75.14; 166/208

(58) Field of Classification Search
USPC ..... 285/123.3, 123.4, 84, 85, 88, 89, 308, 285/315, 320; 166/75.14, 96.1, 208, 217, 166/76.1, 378, 85.1, 177.1, 177.5; 277/322, 277/336–339
See application file for complete search history.

(56) References Cited

U.S. PATENT DOCUMENTS

| | | | | |
|---|---|---|---|---|
| 3,361,453 | A | 1/1968 | Brown et al. | |
| 5,163,514 | A * | 11/1992 | Jennings | 166/368 |
| 5,327,965 | A * | 7/1994 | Stephen et al. | 166/208 |
| 5,333,911 | A | 8/1994 | Watkins | |
| 5,490,565 | A * | 2/1996 | Baker | 166/379 |
| 6,983,959 | B2 | 1/2006 | Wolf et al. | |
| 2003/0205385 | A1 | 11/2003 | Duhn et al. | |

FOREIGN PATENT DOCUMENTS

GB 2199102 6/1988

OTHER PUBLICATIONS

PCT International Search Report and Written Opinion for PCT/US2008/056541, dated Oct. 2, 2008.

* cited by examiner

*Primary Examiner* — David Bagnell
*Assistant Examiner* — Ronald Runyan
(74) *Attorney, Agent, or Firm* — Fletcher Yoder, P.C.

(57) ABSTRACT

In one embodiment, the wellhead system includes first and second wellhead components or members. An exemplary first wellhead member includes an internal bore and a first groove, while an exemplary second wellhead member is at least partially disposed within the internal bore such that a second groove of the second wellhead member is aligned with the first groove. The wellhead system may include a locking ring positioned within at least one of the first or second grooves, and a retaining ring at least partially disposed within the internal bore between the first and second wellhead members. Further, in one embodiment, the retaining ring is configured to selectively engage the locking ring to facilitate securing of the second wellhead member to the first wellhead member. Other embodiments of wellhead systems, devices, and methods of coupling the same are also provided.

32 Claims, 6 Drawing Sheets

WELLHEAD COMPONENT COUPLING SYSTEM AND METHOD

CROSS REFERENCE TO RELATED APPLICATIONS

This application claims priority to and benefit of PCT Application No. PCT/US2008/056541, entitled "WELLHEAD COMPONENT COUPLING SYSTEM AND METHOD", filed on Mar 11, 2008, which is herein incorporated by reference in its entirety, which claims priority to and benefit of U.S. Provisional Patent Application No. 60/928,241, entitled "WELLHEAD COMPONENT COUPLING SYSTEM AND METHOD", filed on May 8, 2007, which is herein incorporated by reference in its entirety.

FIELD OF THE INVENTION

The present invention relates generally to wellhead assemblies. More particularly, the present invention relates to a novel coupling system for securing various components of such assemblies to one another.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

As will be appreciated, oil and natural gas have a profound effect on modern economies and societies. Indeed, devices and systems that depend on oil and natural gas are ubiquitous. For instance, oil and natural gas are used for fuel in a wide variety of vehicles, such as cars, airplanes, boats, and the like. Further, oil and natural gas are frequently used to heat homes during winter, to generate electricity, and to manufacture an astonishing array of everyday products.

In order to meet the demand for such natural resources, companies often invest significant amounts of time and money in searching for and extracting oil, natural gas, and other subterranean resources from the earth. Particularly, once a desired resource is discovered below the surface of the earth, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components, such as various casings, valves, fluid conduits, and the like, that control drilling and/or extraction operations. Additionally, such wellhead assemblies may also include components, such as an isolating mandrel ("frac mandrel") and/or fracturing tree, to facilitate a fracturing process.

As will be appreciated, resources such as oil and natural gas are generally extracted from fissures or other cavities formed in various subterranean rock formations or strata. To facilitate extraction of such resources, a well may be subjected to a fracturing process that creates one or more man-made fractures in a rock formation that connect a number of these pre-existing fissures and cavities, allowing oil, gas, or the like to flow from multiple pre-existing fissures and cavities to the well via the man-made fractures. Such fracturing processes typically include injecting a fluid into the well to form the man-made fractures. The pressure of the fracturing fluid, however, may be greater than the pressure rating of certain components of a wellhead assembly.

Consequently, a frac mandrel is often utilized in such cases to isolate one or more lower-rated components from the fracturing pressure. The frac mandrel is typically inserted within a bore of the wellhead assembly and includes a body having a fluid passageway, such that the body isolates the lower-rated components from the pressure of the fracturing fluid injected into the well via the fluid passageway. Once the fracturing process is completed, the frac mandrel and other fracturing components may be removed from the wellhead assembly, and additional production components, such as a "Christmas tree," may be coupled to the assembly.

SUMMARY

Certain aspects commensurate in scope with the originally claimed invention are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present invention generally relate to a novel system and method for coupling wellhead components to one another. In certain embodiments, wellhead components, such as frac mandrels, tubing spools, or the like, are coupled together via a locking assembly including a locking ring and a retaining ring. In an exemplary embodiment, the locking ring is retained within a groove of a frac mandrel by the retaining ring, to allow the frac mandrel to be freely inserted into, and removed from, a tubing spool or other wellhead component. An exemplary tubing spool includes an internal groove configured to align with the groove of the frac mandrel. In one embodiment, the frac mandrel may be inserted into the tubing spool and the retaining ring may then be moved to permit the locking ring to extend into the groove of the tubing spool, thereby locking the frac mandrel to the tubing spool. Removal of the frac mandrel may be effected by moving the retaining ring back into engagement with the locking ring, drawing the locking ring out of the tubing spool groove and allowing the frac mandrel to be pulled from the tubing spool.

Various refinements of the features noted above may exist in relation to various aspects of the present invention. Further features may also be incorporated in these various aspects as well. These refinements and additional features may exist individually or in any combination. For instance, various features discussed below in relation to one or more of the illustrated embodiments may be incorporated into any of the above-described aspects of the present invention alone or in any combination. Again, the brief summary presented above is intended only to familiarize the reader with certain aspects and contexts of the present invention without limitation to the claimed subject matter.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF SPECIFIC EMBODIMENTS

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Figure 1:
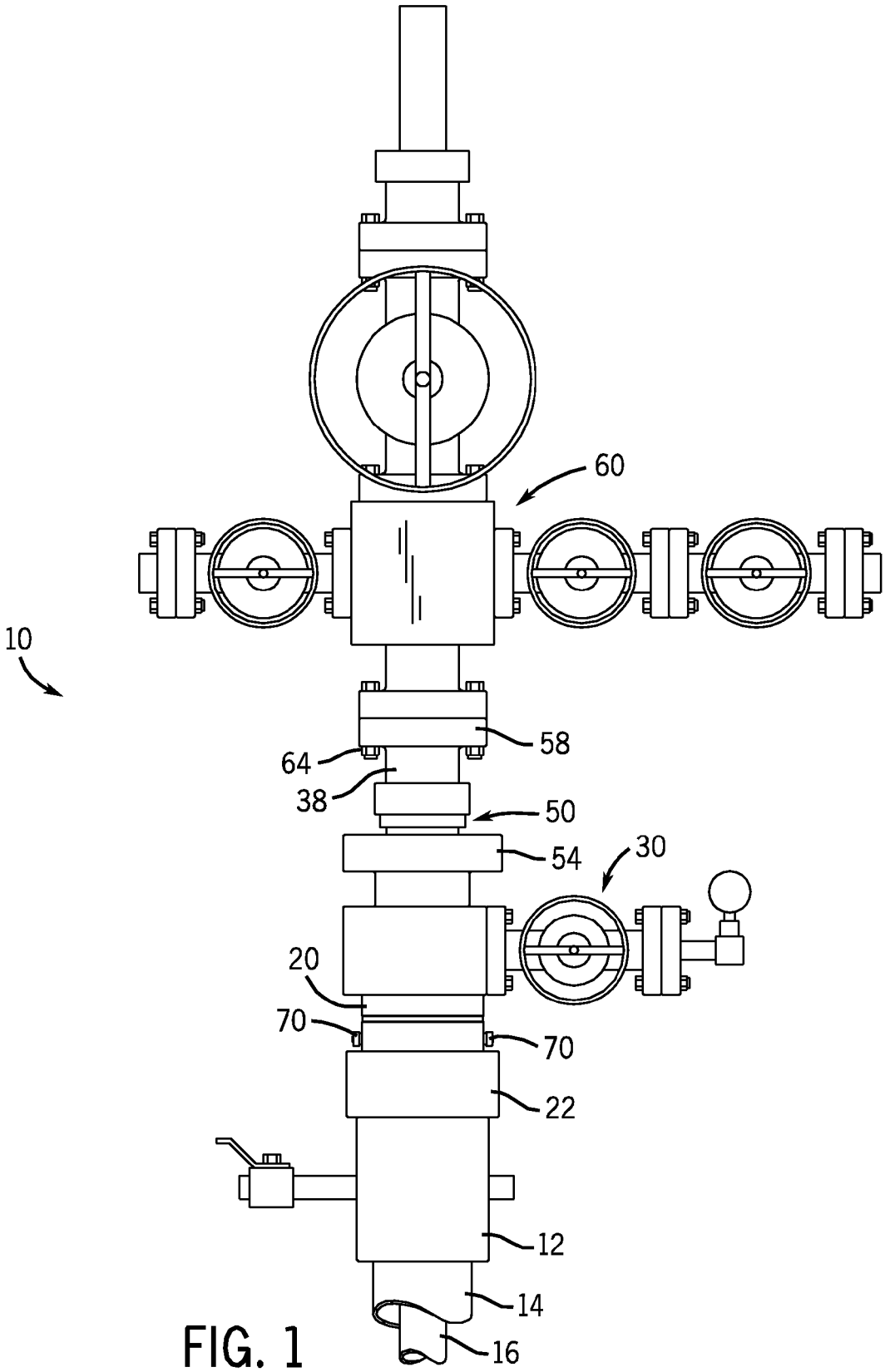
FIG. 1 is a front elevational view of a wellhead assembly having a frac mandrel coupled to a tubing spool via an exemplary locking assembly in accordance with one embodiment of the present invention.
Figure 2:
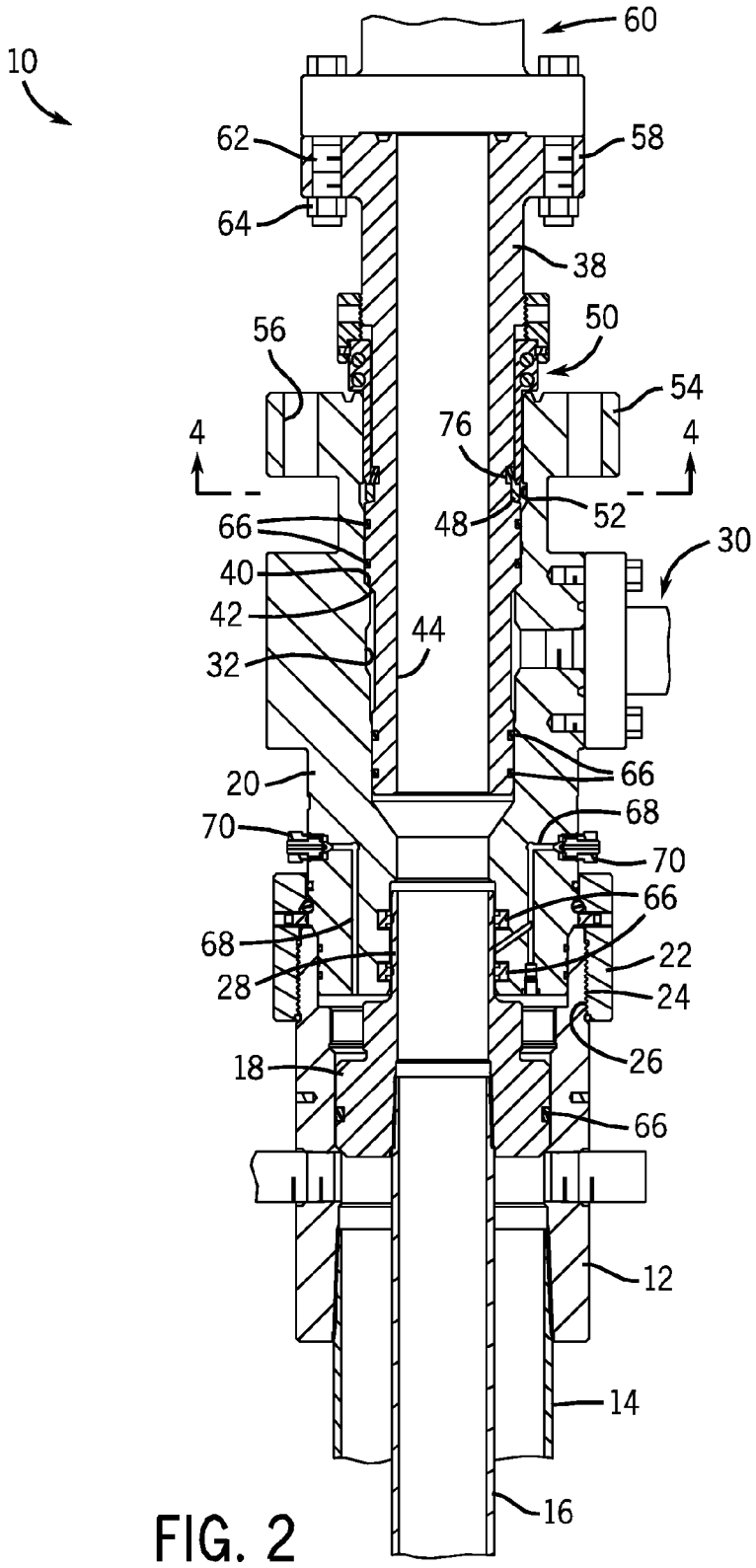
FIG. 2 is a partial cross-sectional view of the exemplary wellhead assembly of FIG. 1, illustrating internal components of the wellhead assembly in accordance with one embodiment of the present invention.

Turning now to the present figures, an exemplary wellhead assembly 10 is provided in FIGS. 1 and 2 in accordance with one embodiment of the present invention. The exemplary wellhead assembly 10 includes a casing head 12 coupled to a surface casing 14. The wellhead assembly 10 also includes a production casing 16, which may be suspended within the casing head 12 and the surface casing 14 via a casing hanger 18. It will be appreciated that a variety of additional components may be coupled to the casing head 12 to facilitate production from a subterranean well.

For instance, in one embodiment, a tubing head or spool 20 is coupled to the casing head 12. In the presently illustrated embodiment, the tubing spool 20 is coupled to the casing head 12 via a union nut 22, which is threaded onto the casing head 12 via complementary threaded surfaces 24 and 26. Of course, it will be appreciated that wellhead members, such as the tubing spool 20, may be coupled to the casing head 12 in any suitable manner, including through the use of various other connectors, collars, or the like. In one embodiment, the tubing spool 20 may be adapted to receive an extended portion 28 of the casing hanger 18.

A valve assembly 30 is coupled to the exemplary tubing spool 20 and may serve various purposes, including releasing pressure from an internal bore 32 of the tubing spool 20. The internal bore 32 of the tubing spool 20 is configured to receive one or more additional wellhead members or components, such as a frac mandrel 38. As will be appreciated, operating pressures within the wellhead assembly 10 are typically greater during a fracturing process than during ordinary production. In order to protect components of the wellhead assembly 10 having a lower pressure rating (i.e., below the expected fracturing pressure) from such excessive pressure, the frac mandrel 38 may be advantageously introduced within the bore 32 to isolate the portions of the wellhead assembly 10 from such pressure.

The exemplary tubing spool 20 includes a tapered landing surface 40 configured to abut a complementary tapered surface 42 of the frac mandrel 38. In some embodiments, the tapered surfaces 40 and 42 cooperate to align grooves 52 and 76 of the tubing spool 20 and the frac mandrel 38, respectively, opposite one another when the frac mandrel 38 is inserted into the internal bore 32. It will be appreciated that the frac mandrel 38 includes a bore 44 through which fracturing fluids may be injected into the well to facilitate future production.

In one embodiment, a locking ring 48, which is part of a locking assembly 50, may be utilized to secure the frac mandrel 38 to the tubing spool 20, as discussed in greater detail below. The exemplary tubing spool 20 also includes a flange 54 having a plurality of mounting apertures 56 to facilitate coupling of various components or wellhead members, such as additional valves or a "Christmas tree," to the tubing spool 20. The frac mandrel 38 may similarly include a mounting flange 58 to enable coupling of additional components to the frac mandrel 38. For instance, in the presently illustrated embodiment, a fracturing tree 60 is coupled to the flange 58 via studs 62 and nuts 64. The fracturing tree 60 or other additional components, however, may be coupled to the frac mandrel through other suitable methods in full accordance with the present techniques.

The exemplary wellhead assembly 10 includes various seals 66 to isolate pressures within different sections of the wellhead assembly 10. For instance, as illustrated, such seals 66 include seals disposed between the casing head 12 and the casing hanger 18, between the casing hanger 18 and the tubing spool 20, and between the tubing spool 20 and the frac mandrel 38. Further, various components of the wellhead assembly 10, such as the tubing spool 20, may include internal passageways 68 that allow testing of one or more of the seals 66. When not being used for such testing, these internal passageways 68 may be sealed from the exterior via plugs 70.

Figure 3:
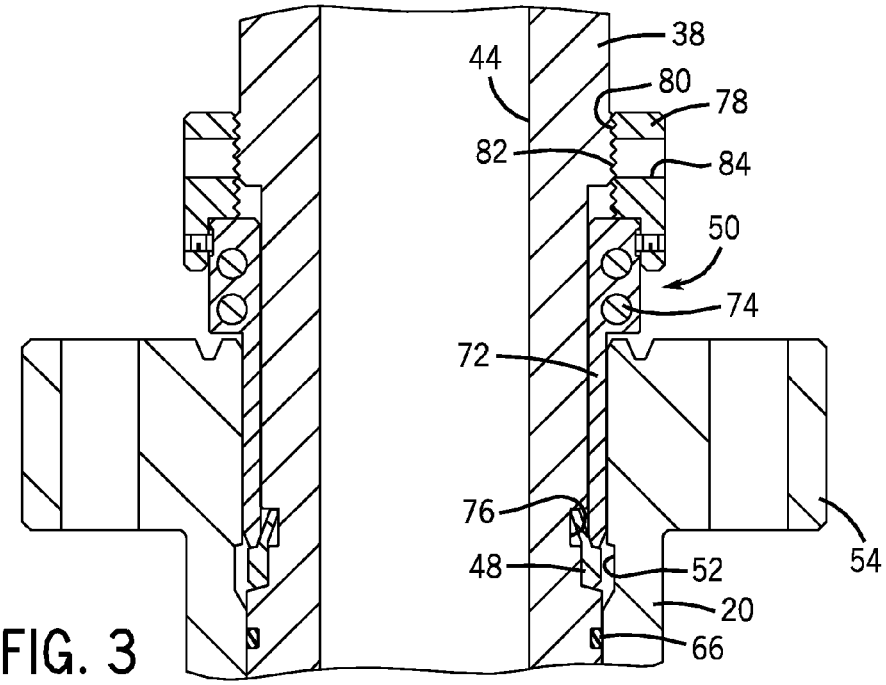
FIG. 3 is a detail view illustrating exemplary components of the locking assembly of FIG. 2 in an unlocked position in accordance with one embodiment of the present invention.

Operation of the locking assembly 50, and an exemplary method for locking wellhead components to one another, may be better understood with reference to FIGS. 3-6. Particularly, FIG. 3 is a partial detail view of the locking assembly 50. The exemplary locking assembly 50 includes a retaining ring 72 configured to selectively retain the locking ring 48 within the groove 76 of the frac mandrel 38. In some embodiments, the locking ring 48 is a split locking ring, such as a C-ring or a segmented ring. Particularly, in the presently illustrated embodiment, the locking ring 48 is a C-ring that is outwardly biased when disposed within the groove 76. The exemplary retaining ring 72 is formed from a plurality of members coupled to one another via one or more fasteners 74 to facilitate assembly of the retaining ring 72 on the frac mandrel 38, although a single-piece retaining ring could instead be used in other embodiments.

Notably, the exemplary retaining ring 72 is configured to move between a first position, in which the retaining ring 72 retains the locking ring 48 within the groove 76, and a second position (see FIG. 5) that allows a portion of the locking ring 48 to extend outwardly from the groove 76 and into the groove 52. In the presently illustrated embodiment, the locking assembly 50 also includes a locking nut 78 that is coupled to the retaining ring 72 to facilitate movement of the retaining ring 72 between the first and second positions noted above. Particularly, the exemplary locking nut 78 includes a threaded surface 80 that engages a complementary threaded surface 82 of the frac mandrel 38 such that rotation of the locking nut 78 effects axial movement of the retaining ring 72 between the first and second positions. Further, the locking nut 78 may include various tool recesses 84 that allow a user to more easily rotate the locking nut 78.

It will be appreciated that, when the locking ring 48 is fully retained within the groove 76, the locking ring 48 does not interfere with insertion or removal of the frac mandrel 38 from the internal bore 32 of the tubing spool 20. Thus, in at least one exemplary coupling method, the locking ring 48 is inserted within the groove 76 and the retaining ring 72 is then moved into the first position to engage the locking ring 48 and retain it within the groove 76. The frac mandrel 38 may then be inserted into the internal bore 32 until the tapered surface 42 of the frac mandrel 38 abuts the tapered landing 40 of the tubing spool 20, as discussed above.

Figure 5:
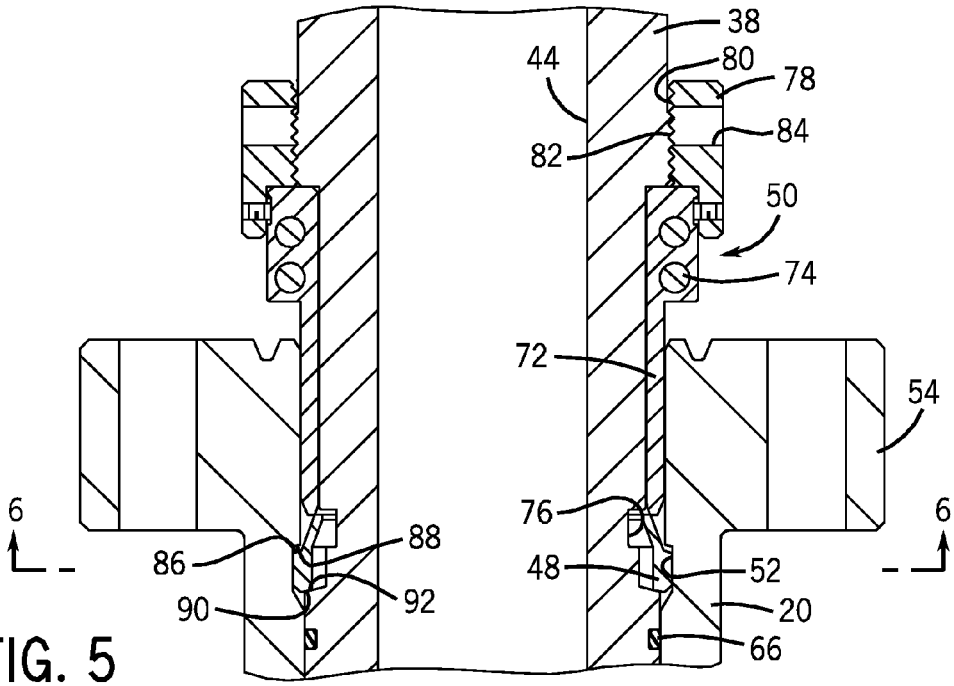
FIG. 5 is a detail view of the exemplary components of the locking assembly of FIG. 3, in which the locking assembly has been moved into a locked position in accordance with one embodiment of the present invention.
Figure 4:
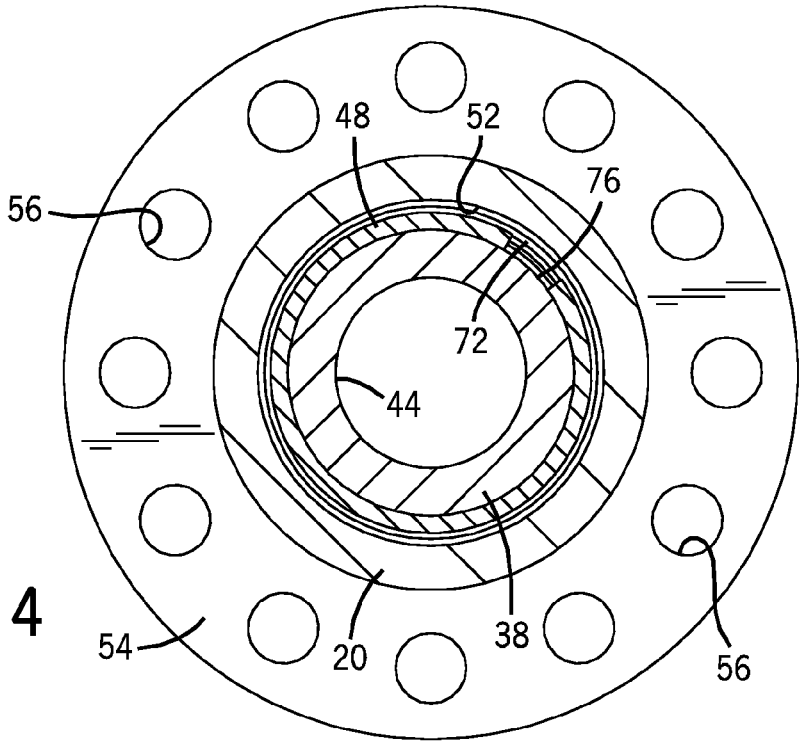
FIG. 4 is an axial cross-sectional view of the exemplary wellhead assembly taken along the line 4-4 of FIG. 2.
Figure 6:
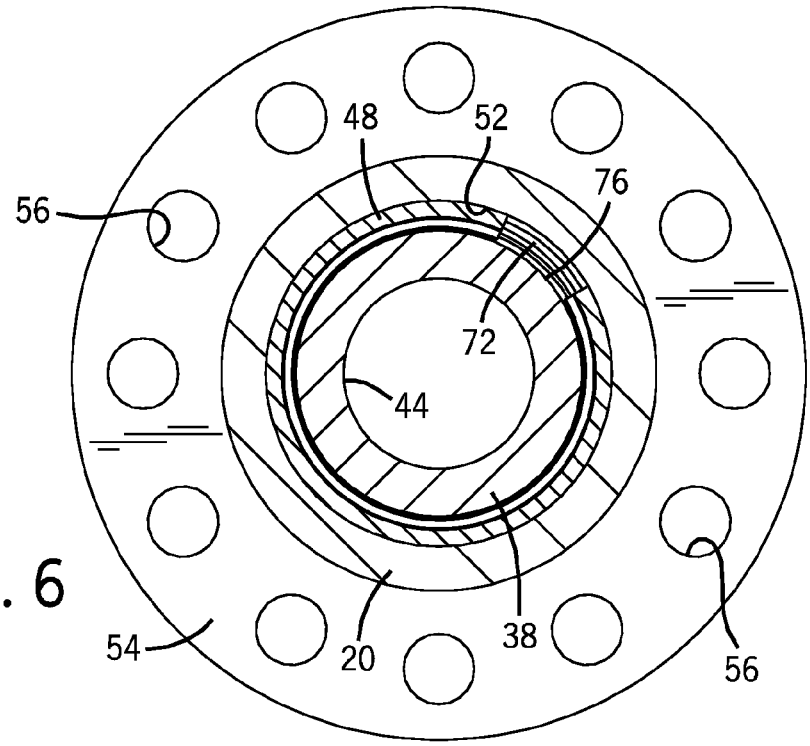
FIG. 6 is an axial cross-sectional view of the exemplary wellhead assembly taken along line 6-6 of FIG. 5.

As may be seen in FIG. 4, which is an axial cross-section of the exemplary wellhead assembly 10 taken along the line 4-4 in FIG. 2, the locking ring 48 is fully disposed within the groove 76, and does not inhibit axial movement of the frac mandrel 38 with respect to the tubing spool 20. Consequently, the locking ring 48 and the retaining ring 72 may be considered to be in an unlocked position, which allows the frac mandrel 38 to be freely inserted and removed from the tubing spool 20. Once the frac mandrel 38 is positioned within the internal bore 32 of the tubing spool 20, the retaining ring may be moved out of engagement with the locking ring 48 and into a second, locked position, as generally illustrated in FIGS. 5 and 6.

Because the exemplary locking ring 48 is outwardly biased, movement of the retaining ring 72 out of engagement with the locking ring 48 causes a portion of the locking ring 48 to extend into the groove 52 of the tubing spool 20. In other embodiments employing a non-biased locking ring, however, the locking ring may be manually extended into the groove 52. Notably, the groove 52 has a depth less than the radial thickness of the locking ring 48 such that the locking ring 48 remains partially within the groove 76 while extending also into the groove 52 when the retaining ring 72 is moved out of the engagement with the locking ring 48. Consequently, the locking ring 48 essentially straddles the two grooves 52 and 76, and inhibits substantial axial movement of the frac mandrel 38 with respect to the tubing spool 20. More particularly, the abutment of a surface 86 of the locking ring 48 with a complementary surface 88 of the tubing spool 20, along with the abutment of a surface 90 of the locking ring 48 and a surface 92 of the frac mandrel 38 minimizes such relative motion and securely locks the frac mandrel 38 to the tubing spool 20. It should also be noted that, through use of the exemplary locking assembly 50 in some embodiments, the frac mandrel 38 is locked to the tubing spool 20 without using any lock screws. In at least one embodiment, the elimination of such lock screws may reduce or eliminate external penetrations into the bore 32 of the tubing spool 20, reduce the number of leak paths in the wellhead assembly 10, and exhibit increased operational safety.

Figure 7:
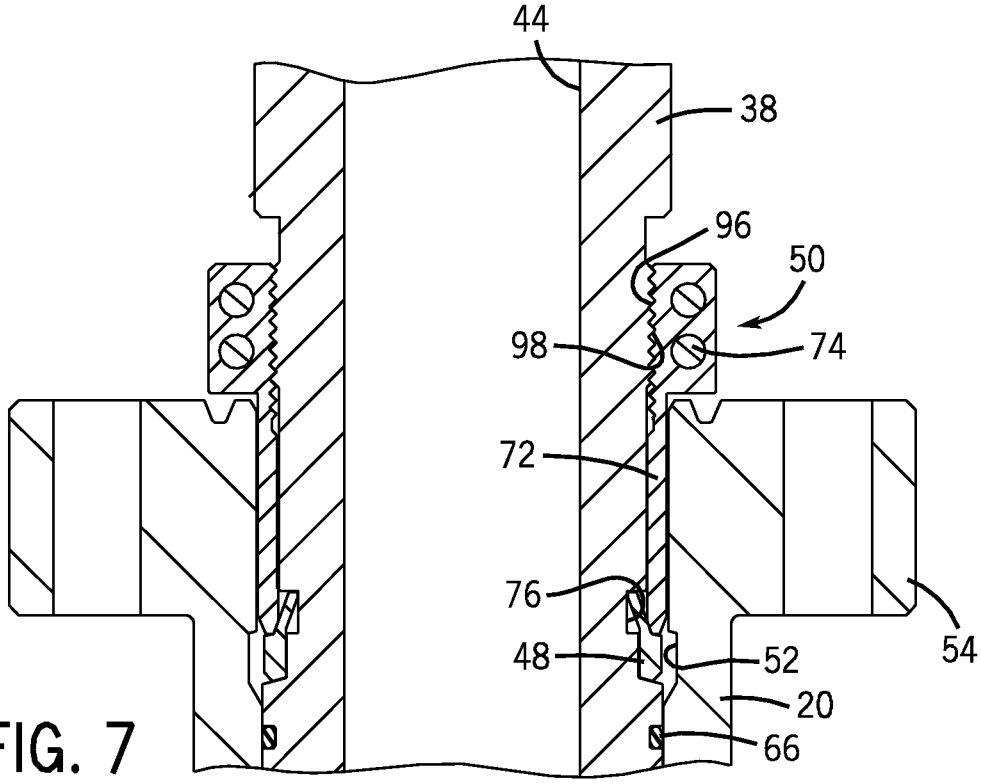
FIG. 7 is a detail view of an exemplary locking assembly in accordance with one embodiment of the present invention.

While one exemplary locking assembly 50 is described in detail above, it will be appreciated that other embodiments may include a locking assembly having a different configuration. For instance, as illustrated in FIG. 7, the locking nut 78 may be omitted in various embodiments. In some embodiments, the retaining ring 72 may be directly threaded onto the frac mandrel 38 via complementary threaded surfaces 96 and 98. Further, in some embodiments, the retaining ring 72 may be replaced by a plurality of distinct retaining members. The use of an inwardly-biased locking ring selectively retained within the groove 52, in which the locking ring is configured to radially contract such that the locking ring may be partially located within both of grooves 52 and 76, is also envisaged.

Figure 8:
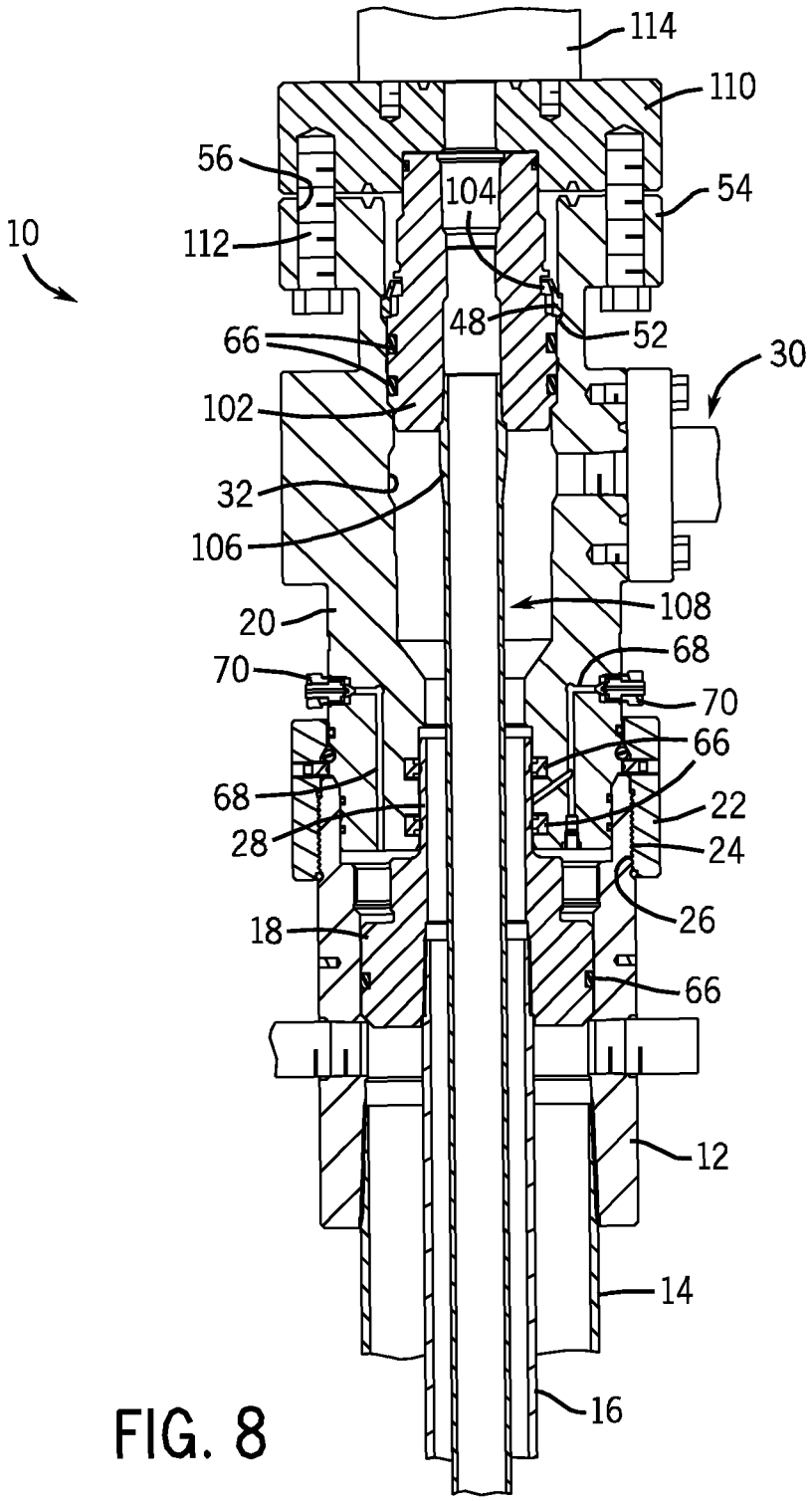
FIG. 8 is partial cross-sectional view of the exemplary wellhead assembly of FIG. 1, illustrating an additional component coupled to the tubing spool in place of the frac mandrel, in accordance with one embodiment of the present invention.

To facilitate removal of the frac mandrel 38 from the tubing spool 20, such as after a fracturing process is completed, the retaining ring 72 may be moved to the unlocked position to engage the locking ring 48 and again retain it within the groove 76, as generally illustrated and discussed above with respect to FIGS. 3 and 4. Once the frac mandrel 38 is unsecured from the tubing spool 20, it may be removed from the internal bore 32, allowing other components to be disposed within the internal bore 32 and/or coupled to the tubing spool 20, such as generally illustrated in FIG. 8.

For instance, a tubing hanger 102 may be disposed within the internal bore 32 and coupled thereto via a similar locking ring 48. As will be appreciated in view of the discussion above, the locking ring 48 of the tubing hanger 102 may be retained within a groove 104 of the tubing hanger 102 during installation, and may then be released such that an outward bias on the locking ring 48 causes the locking ring 48 to be positioned partially within both the grooves 52 and 104. Also, production tubing 106 may be suspended from the tubing hanger 102 within the wellhead bore 108. Further, once the tubing hanger 102 is installed, a tubing head adapter 110 may be coupled to the flange 54. The tubing head adapter 110 may be secured to the flange 54 via bolts 112 inserted through mounting apertures 56 and into threaded recesses of the tubing head adapter 110, or through other suitable means. It should also be noted that a variety of other components 114 may be coupled to the tubing spool 20 via the tubing head adapter 110, such as a "Christmas tree" or other valve assembly, in full accordance with the present techniques.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A wellhead system comprising:

a first wellhead member including an internal bore and a first groove formed in the internal bore;

a second wellhead member at least partially disposed within the internal bore of the first wellhead member, wherein the second wellhead member includes a second groove formed in an outer surface of the second wellhead member, the first and the second grooves are positioned opposite one another, the second wellhead member comprises an additional internal bore configured to facilitate flow of a fluid through the second wellhead member, and the second wellhead member is configured to facilitate isolation of at least a portion of the first wellhead member from a pressure within the additional internal bore that is substantially equal to or greater than a pressure rating of the first wellhead member;

a locking ring positioned within at least one of the first or the second grooves, wherein the locking ring itself has a self bias from an unlocked position toward a locked position;

a retaining ring at least partially disposed within the internal bore between the first and the second wellhead members; and an actuating member configured to selectively bias the retaining ring in response to a rotational movement, wherein the retaining ring is configured to selectively hold the locking ring in the unlocked position, and the retaining ring is configured to selectively release the locking ring to undergo self-biased movement from the unlocked position to the locked position in response to the rotational movement of the actuating member to secure the second wellhead member to the first wellhead member via the locking ring.

2. The wellhead system of claim 1, wherein the first wellhead member comprises a tubing spool.

3. The wellhead system of claim 1, wherein the second wellhead member comprises a frac mandrel.

4. The wellhead system of claim 3, comprising a fracturing tree coupled to the frac mandrel.

5. The wellhead system of claim 1, wherein the locking ring is disposed in only one of the first and the second grooves in the unlocked position, and the locking ring is partially disposed in each of the first and the second grooves in the locked position.

6. The wellhead system of claim 5, wherein the locking ring and the retaining ring are configured such that the locking ring is disposed only within the second groove of the second wellhead member in the unlocked position of the locking ring.

7. The wellhead system of claim 6, wherein the retaining ring is configured to directly engage the locking ring and retain the locking ring within the second groove in the unlocked position of the locking ring.

8. The wellhead system of claim 1, wherein the retaining ring is configured to disengage the locking ring to enable the self-biased movement of the locking ring from the second groove in the unlocked position to the locked position partially disposed within each of the first and second grooves.

9. The wellhead system of claim 8, wherein the locking ring itself is outwardly self-biased when disposed within the second groove such that the outward self-bias of the locking ring effects movement of the locking ring from the second groove in the unlocked position to the locked position partially disposed within each of the first and the second grooves when the retaining ring disengages the locking ring.

10. The wellhead system of claim 1, wherein the locking ring comprises a split locking ring.

11. The wellhead system of claim 1, wherein the locking ring comprises a single body.

12. The wellhead system of claim 1, wherein the locking ring itself is configured to be outwardly self-biased when positioned within at least one of the first or the second grooves.

13. The wellhead system of claim 1, wherein the retaining ring is configured to undergo an axial movement in response to the rotational movement of the actuating member to cause a radial movement of the locking ring.

14. The wellhead system of claim 13, wherein a threaded engagement of first and second threads is configured to enable the rotational movement of the actuating member.

15. A wellhead system comprising:

a first wellhead member comprising a body having a first groove formed in an outer surface of the body, wherein the first wellhead member is configured to be at least partially disposed within a second wellhead member and to enable alignment of the first groove with a second groove formed in the second wellhead member, and the first wellhead member is a frac mandrel; and a locking assembly coupled to the first wellhead member, the locking assembly comprising:

at least one locking member disposed within the first groove;

at least one retaining member coupled to the first wellhead member;

an actuating member configured to selectively bias the at least one retaining member in response to a rotational movement, wherein the at least one retaining member is configured to selectively retain the at least one locking member in the first groove in response to the rotational movement of the actuating member;

wherein the at least one locking member and the at least one retaining member are configured such that, when the first wellhead member is at least partially disposed within the second wellhead member and the first and the second grooves are aligned, movement of the at least one retaining member from a first position, in which the at least one locking member is retained in the first groove, to a second position, in which the at least one locking member straddles the first and the second grooves, effects securing of the first wellhead member to the second wellhead member; and wherein the actuating member comprises a locking nut threaded onto the first wellhead member, coupled to the at least one retaining member, and configured such that rotation of the locking nut facilitates axial movement of the at least one retaining member into, and out of, engagement with the at least one locking member.

16. The wellhead system of claim 15, wherein the at least one retaining member is generally circumferentially disposed about the first wellhead member.

17. The wellhead system of claim 15, wherein the at least one retaining member comprises a retaining ring threaded onto the first wellhead member.

18. The wellhead system of claim 15, wherein the at least one retaining member is configured to undergo an axial movement in response to the rotational movement of the actuating member to cause a radial movement of the at least one locking member.

19. The wellhead system of claim 15, wherein the actuating member is configured to undergo the rotational movement along a threaded interface.

20. A method comprising:

inserting a first wellhead member at least partially into an internal bore of a second wellhead member such that a groove in the first wellhead member is aligned with a complimentary groove in the second wellhead member, wherein the first wellhead member comprises an additional internal bore configured to facilitate flow of a fluid through the first wellhead member, and the first wellhead member is configured to facilitate isolation of at least a portion of the second wellhead member from a pressure within the additional internal bore that is substantially equal to or greater than a pressure rating of the second wellhead member;

holding, via a retaining member in a first position, a locking member in an unlocked position in only one of the groove or the complimentary groove;

rotating an actuating member to bias the retaining member to move from the first position to a second position, thereby releasing the locking member from the retaining member to undergo a self-biased movement from the unlocked position to a locked position, wherein the locking member is disposed within both the groove and the complimentary groove in the locked position; and securing the first wellhead member to the second wellhead member via the locking member in the locked position.

21. The method of claim 20, wherein securing comprises axially moving the retaining member in response to the rotational movement of the actuating member to cause a radial movement of the biased locking member.

22. A wellhead system, comprising:

an isolation sleeve configured to mount within a wellhead member, wherein the isolation sleeve comprises a first groove disposed directly in an outer surface of the isolation sleeve; and a locking ring disposed about the isolation sleeve, wherein the locking ring is disposed directly in the first groove of the isolation sleeve, and the locking ring is configured to move from an unlocked position to a locked position to secure the isolation sleeve within the wellhead member; and a retaining ring disposed about the isolation sleeve, wherein the retaining ring is configured to selectively extend around the locking ring to hold the locking ring in the unlocked position.

23. The wellhead system of claim 22, comprising the wellhead member having a second groove disposed directly in an inner surface of the wellhead member, wherein the locking ring is disposed in both the first groove and the second groove in the locked position of the locking ring.

24. The wellhead system of claim 23, wherein the locking ring is disposed only in the first groove and not in the second groove in the unlocked position of the locking ring.

25. The wellhead system of claim 24, wherein the retaining ring is disposed between the isolation sleeve and the wellhead member, and the retaining ring is configured to selectively extend around the locking ring to hold the locking ring in the unlocked position such that the locking ring is disposed only in the first groove and not in the second groove.

26. The wellhead system of claim 22, wherein the locking ring is disposed directly between the retaining ring and the first groove in the isolation sleeve, the retaining ring is configured to selectively move away from the locking ring along an axis of the isolation sleeve to release the locking ring, and the release of the locking ring is configured to enable an outward bias of the locking ring itself to expand the locking ring to the locked position in which the locking ring is disposed in both the first groove and the second groove.

27. The wellhead system of claim 26, comprising an actuator configured to move along the axis of the isolation sleeve to selectively contact and bias the retaining ring from a first position to a second position, wherein the first position of the retaining ring has the retaining ring extending around the locking ring to hold the locking ring in the unlocked position such that the locking ring is disposed only in the first groove and not in the second groove, and the second position of the retaining ring has the retaining ring moved away from the locking ring to release the locking ring.

28. The wellhead system of claim 27, wherein the actuator comprises a locking nut threaded directly onto the isolation sleeve.

29. The wellhead system of claim 22, wherein the retaining ring is configured to selectively extend around the locking ring to hold the locking ring in the unlocked position in the first groove, and the retaining ring is configured to selectively move away from the locking ring to enable expansion of the locking ring at least partially out of the first groove.

30. The wellhead system of claim 29, comprising a threaded actuator disposed about the isolation sleeve, wherein the threaded actuator is configured to selectively move the retaining ring in an axial direction.

31. A wellhead system comprising:

a first wellhead member including an internal bore and a first groove formed in the internal bore;

a second wellhead member at least partially disposed within the internal bore of the first wellhead member, wherein the second wellhead member includes a second groove formed in an outer surface of the second wellhead member, the first and the second grooves are positioned opposite one another, the second wellhead member comprises an additional internal bore configured to facilitate flow of a fluid through the second wellhead member, and the second wellhead member is configured to facilitate isolation of at least a portion of the first wellhead member from a pressure within the additional internal bore that is substantially equal to or greater than a pressure rating of the first wellhead member;

a locking ring selectively disposed in unlocked and locked positions, wherein the locking ring is disposed in only one of the first or second grooves in the unlocked position, and the locking ring is disposed partially in both the first and second grooves in the locked position;

a retaining ring at least partially disposed within the internal bore between the first and the second wellhead members, wherein the retaining ring is configured to directly engage the locking ring and retain the locking ring in only one of the first or second grooves in the unlocked position; and an actuating member configured to selectively bias the retaining ring in response to a rotational movement, wherein the retaining ring is configured to selectively engage the locking ring in response to the rotational movement of the actuating member to facilitate securing of the second wellhead member to the first wellhead member via the locking ring.

32. A wellhead system, comprising:

an isolation sleeve configured to mount within a wellhead member, wherein the isolation sleeve comprises a first groove disposed directly in an outer surface of the isolation sleeve;

a locking ring disposed about the isolation sleeve, wherein the locking ring is disposed directly in the first groove of the isolation sleeve, and the locking ring itself has an outward bias; and a retaining ring disposed about the isolation sleeve, wherein the retaining ring is configured to selectively move between first and second positions, the first position of the retaining ring holds the locking ring in the first groove in an unlocked position that does not secure the isolation sleeve to the wellhead member, and the second position of the retaining ring releases the locking ring to undergo a self-biased movement from the unlocked position to a locked position that secures the isolation sleeve to the wellhead member.

* * * * *